US008849157B2

(12) United States Patent
Itabashi

(10) Patent No.: US 8,849,157 B2
(45) Date of Patent: Sep. 30, 2014

(54) CAP FOR DEVELOPER CONTAINER AND DEVELOPER CONTAINER HAVING THE SAME

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 100 days.

(21) Appl. No.: 13/682,787

(22) Filed: Nov. 21, 2012

(65) Prior Publication Data

US 2013/0136490 A1 May 30, 2013

(30) Foreign Application Priority Data

Nov. 24, 2011 (JP) ..... 2011-256131

(51) Int. Cl.
*G03G 15/08* (2006.01)

(52) U.S. Cl.
CPC ..... *G03G 15/0832* (2013.01); *G03G 15/0886* (2013.01); *G03G 15/0865* (2013.01)
USPC ..... 399/120; 399/106; 399/111; 399/102; 399/103

(58) Field of Classification Search
USPC ..... 399/35, 120, 102, 103, 106, 111, 262, 399/25
See application file for complete search history.

(56) References Cited

U.S. PATENT DOCUMENTS

| | | | | |
|---|---|---|---|---|
| 7,162,190 | B2 | 1/2007 | Deguchi | |
| 7,325,385 | B2 | 2/2008 | Nagashima et al. | |
| 7,970,311 | B2 | 6/2011 | Nakamura et al. | |
| 8,270,877 | B2 * | 9/2012 | Tomatsu et al. | 399/167 |
| 2005/0028492 | A1 | 2/2005 | Nagashima et al. | |
| 2006/0165441 | A1 | 7/2006 | Deguchi | |
| 2008/0138119 | A1 * | 6/2008 | Li et al. | 399/262 |
| 2008/0145094 | A1 | 6/2008 | Nakamura et al. | |

FOREIGN PATENT DOCUMENTS

| | | | |
|---|---|---|---|
| CN | 1536451 | A | 10/2004 |
| CN | 1811613 | A | 8/2006 |
| CN | 1811615 | A | 8/2006 |
| JP | 03-069664 | | 7/1991 |
| JP | 06-208301 | A | 7/1994 |
| JP | 2004-085597 | A | 3/2004 |
| JP | 2005-055784 | A | 3/2005 |

(Continued)

OTHER PUBLICATIONS

Office action received in corresponding Chinese Patent Application No. 201210480212.5, dated Jul. 1, 2014.

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

In a cap for sealing a filling port formed in a developer container, a base is in the shape of a circular plate. A first cylindrical portion is in the shape of a cylinder extending from a peripheral portion of the base in a first direction. A second cylindrical portion is in the shape of a cylinder extending from the peripheral portion of the base in a second direction that is opposite to the first direction. A first projecting portion projects radially outwardly from an outer circumferential surface of the first cylindrical portion with a predetermined projecting amount. A second projecting portion projects radially outwardly from an outer circumferential surface of the second cylindrical portion with a projecting amount equal to the predetermined projecting amount of the first projecting portion.

21 Claims, 6 Drawing Sheets

3

(56) References Cited

FOREIGN PATENT DOCUMENTS

| | | | |
|---|---|---|---|
| JP | 2006-208837 | A | 8/2006 |
| JP | 2008-145907 | A | 6/2008 |
| JP | 2011-221176 | A | 11/2011 |

* cited by examiner

CAP FOR DEVELOPER CONTAINER AND DEVELOPER CONTAINER HAVING THE SAME

CROSS REFERENCE TO RELATED APPLICATION

This application claims priority from Japanese Patent Application No. 2011-256131 filed Nov. 24, 2011. The entire content of this priority application is incorporated herein by reference.

TECHNICAL FIELD

The present invention relates to a cap for a developer container and to a developer container having the same.

BACKGROUND

There has been conventionally known a developer container having a container body formed with a toner filling port and a toner cap closing the toner filling port. One example of such a toner cap includes an insertion part and a flange part. The insertion part has a base end and a tip end opposite to the base end. The flange part extends radially outwardly from the base end of the insertion part. The insertion part is inserted into the toner filling port. The flange part is bonded to an external surface of the container body by welding.

SUMMARY

When attaching the toner cap onto the container body, the toner cap is oriented such that the tip end of the insertion part faces the filling port and the flange part faces part of the external surface of the container body that surrounds the filling port. Then, the insertion part is inserted into the filling port. It is troublesome to attach the toner cap to the container body in this way.

In view of the above, it is an object of the present invention to provide an improved cap that can be attached to a container body more easily and an improved developer container having the cap.

In order to attain the above and other objects, the invention provides a cap for sealing a filling port formed in a developer container. The cap includes: a base; a first cylindrical portion; a second cylindrical portion; a first projecting portion; and a second projecting portion. The base is in the shape of a circular plate. The first cylindrical portion is in the shape of a cylinder extending from a peripheral portion of the base in a first direction. The second cylindrical portion is in the shape of a cylinder extending from the peripheral portion of the base in a second direction that is opposite to the first direction. The first projecting portion projects radially outwardly from an outer circumferential surface of the first cylindrical portion with a predetermined projecting amount, the first projecting portion extending along a circumferential direction of the first cylindrical portion over an entire circumferential length of the first cylindrical portion. The second projecting portion projects radially outwardly from an outer circumferential surface of the second cylindrical portion with a projecting amount equal to the predetermined projecting amount of the first projecting portion, the second projecting portion extending along a circumferential direction of the second cylindrical portion over an entire circumferential length of the second cylindrical portion.

According to another aspect, the present invention provides a developer container including: a container body formed with a filling port for filling developer; and a cap mounted on the container body. The container body has a partition surface in the shape of a cylinder, the partition surface defining the filling port. The cap includes: a base; a first cylindrical portion; a second cylindrical portion; a first projecting portion; and a second projecting portion. The base is in the shape of a circular plate. The first cylindrical portion is in the shape of a cylinder extending from a peripheral portion of the base to a downstream side in a cap mounting direction, in which the cap is mounted. The second cylindrical portion is in the shape of a cylinder extending from the peripheral portion of the base to an upstream side in the cap mounting direction. The first projecting portion projects radially outwardly from an outer circumferential surface of the first cylindrical portion, the first projecting portion extending along a circumferential direction of the first cylindrical portion over an entire circumferential length of the first cylindrical portion, an entire length of the partition surface along a circumferential direction of the partition surface being in contact with the first projecting portion. The second projecting portion projects radially outwardly from an outer circumferential surface of the second cylindrical portion, the second projecting portion extending along a circumferential direction of the second cylindrical portion over an entire circumferential length of the second cylindrical portion, an entire length of the partition surface along the circumferential direction of the partition surface being in contact with the second projecting portion.

BRIEF DESCRIPTION OF THE DRAWINGS

The particular features and advantages of the invention as well as other objects will become apparent from the following description taken in connection with the accompanying drawings, in which:

FIGS. 2A-2D are diagrams showing a cap according to the first embodiment, wherein FIG. 2A is a perspective view of the cap, FIG. 2B is a diagram of the cap when seen from a radial direction, FIG. 2C is a diagram of the cap when seen from a front side (rear side) along a front-rear direction, and FIG. 2D is a cross-sectional view of the cap;

FIGS. 4A-4C are diagrams showing a cap according to a second embodiment, wherein FIG. 4A is a perspective view of the cap, FIG. 4B is a diagram of the cap when seen from a front side (rear side) along the front-rear direction, and FIG. 4C is a cross-sectional view showing a situation where the cap is mounted on the container body;

FIGS. 5A-5C are diagrams showing a cap according to a third embodiment, wherein FIG. 5A is a perspective view of the cap, FIG. 5B is a diagram of the cap when seen from a radial direction, and FIG. 5C is a cross-sectional view showing a situation where the cap is mounted on the container body.

DETAILED DESCRIPTION

First Embodiment

1. Configuration of Developer Container

Figure 1:
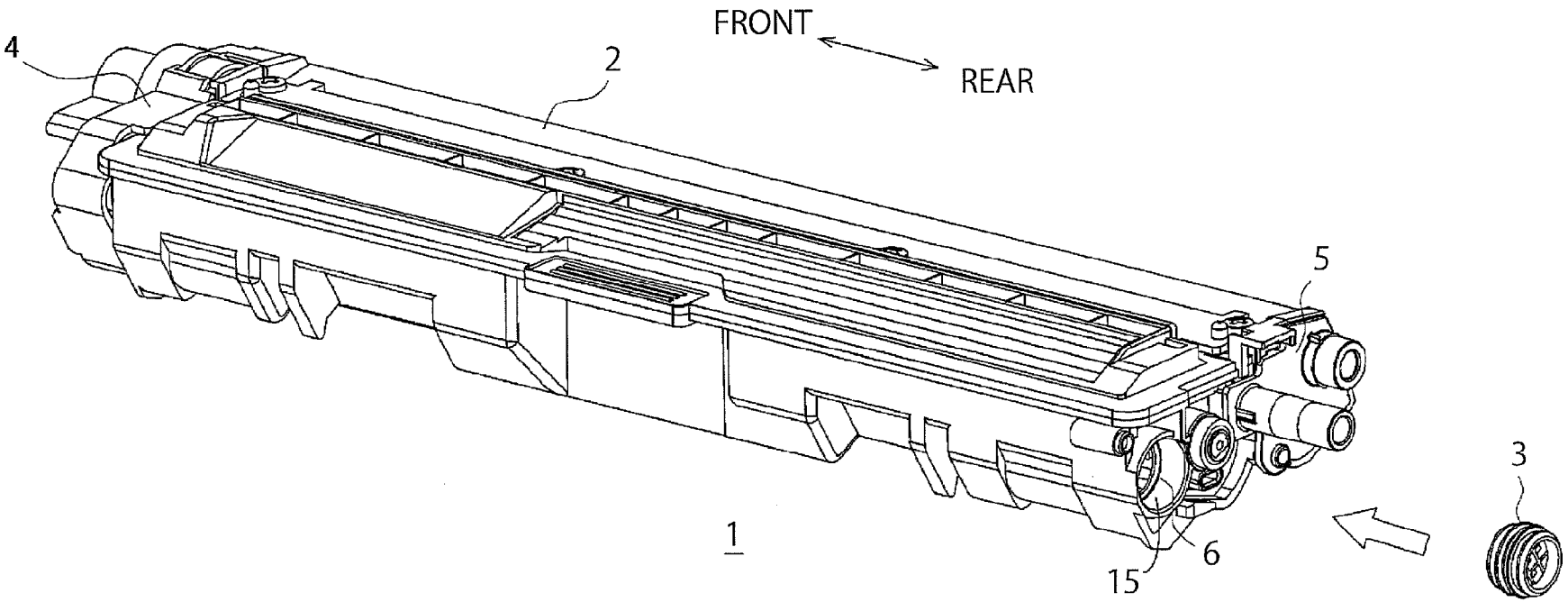
FIG. 1 is a perspective view of a developer container according to a first embodiment of the present invention.

First, a developer container 1 according to a first embodiment will be described with reference to FIG. 1. Incidentally, as for the directions in the following description, as shown in FIG. 1, a direction in which a cap 3 is mounted (or the direction indicated by an arrow) is referred to as front-rear direction. The cap 3 is mounted from a rear side to a front side. Moreover, a direction perpendicular to the front-rear direction is referred to as radial direction.

As shown in FIG. 1, the developer container 1 includes a container body 2 and the cap 3. The container body 2 is for storing toner (developer) therein. The cap 3 is mounted on the container body 2.

The container body 2 includes a front wall 4 and a rear wall 5. A filling port 6 is formed on the rear wall 5. The filling port 6 is in fluid communication with the inside of the container body 2. The filling port 6 is for receiving toner, with which the container body 2 is to be filled.

The cap 3 is used to close or seal the filling port 6, thereby preventing leakage of toner from the inside of the container body 2. When mounting the cap 3 on the container body 2, the cap 3 is first positioned at the rear side relative to the filling port 6 and then moved to the front side so that the cap 3 is finally mounted on the container body 2 and seals the filling port 6.

2. Configuration of Cap

Next, the configuration of the cap 3 will be described in greater detail with reference to FIGS. 2A-2D.

The cap 3 is made of elastic material such as rubber, and is formed by a metal mold. The cap 3 includes: a base 7; a first cylindrical portion 8; a second cylindrical portion 9; a first projecting portion 10; a second projecting portion a third projecting portion 12; and a fourth projecting portion 13.

The base 7 is in the shape of a circular plate. As shown in FIG. 2D, the base 7 is positioned at the center of the cap 3 in the front-rear direction. The diameter of the base 7 is 10 mm.

The first cylindrical portion 8 is in the shape of a cylinder or tube, extending from a peripheral portion of the base 7 to the front side.

The third projecting portion 12 is provided at a front end of the cap 3. The third projecting portion 12 projects radially outwardly from an outer circumferential surface of the first cylindrical portion 8. The third projecting portion 12 extends along a circumferential direction of the first cylindrical portion 8. The third projecting portion 12 extends over an entire circumferential length of the first cylindrical portion 8.

As shown in FIG. 2D, the third projecting portion 12 includes a first orthogonal surface 12A, a first circumferential surface 12B, and a first inclined surface 12C. The first orthogonal surface 12A is positioned at a rear end of the third projecting portion 12, extends radially outwardly from the outer circumference of the first cylindrical portion 8, extends along the entire circumferential length of the first cylindrical portion 8, and is perpendicular to the outer circumferential surface of the first cylindrical portion 8. The first circumferential surface 12B extends straight to the front from an outer edge of the first orthogonal surface 12A. The first inclined surface 12C is connected to a front end of the first circumferential surface 12B, and is gradually inclined radially inwardly toward the front.

The second cylindrical portion 9 is in the shape of a cylinder or tube, extending from the peripheral portion of the base 7 to the rear side.

The fourth projecting portion 13 is provided at a rear end of the cap 3. The fourth projecting portion 13 projects from an outer circumferential surface of the second cylindrical portion 9. The fourth projecting portion 13 extends along the circumferential direction of the second cylindrical portion 9. The fourth projecting portion 13 extends over the entire circumferential length of the second cylindrical portion 9.

The fourth projecting portion 13 includes a second orthogonal surface 13A, a second circumferential surface 13B, and a second inclined surface 13C. The second orthogonal surface 13A is positioned at a front end of the fourth projecting portion 13, extends radially outwardly from the outer circumference of the second cylindrical portion 9, extends along the entire circumferential length of the second cylindrical portion 9, and is perpendicular to the outer circumferential surface of the second cylindrical portion 9. The second circumferential surface 13B extends straight to the rear from an outer edge of the second orthogonal surface 13A. The second inclined surface 13C is connected to a rear end of the second circumferential surface 13B, and is gradually inclined radially inwardly toward the rear.

As shown in FIG. 2D, the front-rear length L1 of the first cylindrical portion 8 (4 mm) is equal to the front-rear length L2 of the second cylindrical portion 9 (4 mm). The outer diameters of the first cylindrical portion 8 and the second cylindrical portion 9 are equal to the diameter of the base 7.

The first projecting portion 10 projects radially outwardly from the outer circumferential surface of the first cylindrical portion 8. The first projecting portion 10 extends along the circumferential direction of the first cylindrical portion 8. The first projecting portion 10 extends over the entire circumferential length of the first cylindrical portion 8. As shown in FIG. 2D, a rear end of the first projecting portion 10 is disposed at the same position as a front end of the base 7 in the front-rear direction.

The first projecting portion 10 includes a first projecting portion 10A and a first contact portion 10B. The first projecting portion 10A projects radially outwardly from the outer circumferential surface of the first cylindrical portion 8. The first contact portion 10B further projects radially outwardly from the center of the first projecting portion 10A in the front-rear direction. The first contact portion 10B is for contacting with a partition surface 15 of the container body 2 to be described later. As shown in FIG. 2D, the first projecting portion 10A has substantially a square-shaped cross-section, and the first contact portion 10B has a semicircular-shaped cross-section.

The second projecting portion 11 projects radially outwardly from the outer circumferential surface of the second cylindrical portion 9. The second projecting portion 11 extends along the circumferential direction of the second cylindrical portion 9. The second projecting portion 11 extends over the entire circumferential length of the second cylindrical portion 9. As shown in FIG. 2D, a front end of the second projecting portion 11 is placed at the same position as a rear end of the base 7 in the front-rear direction.

The second projecting portion 11 includes a second projecting portion 11A and a second contact portion 11B. The second projecting portion 11A projects radially outwardly from the outer circumferential surface of the second cylindrical portion 9. The second contact portion 11B further projects radially outwardly from the center of the second projecting portion 11A in the front-rear direction. The second contact portion 11B is for contacting with the partition surface 15 of the container body 2 to be described later. As shown in FIG. 2D, the second projecting portion 11A has substantially a square-shaped cross-section, and the second contact portion 11B has a semicircular-shaped cross-section.

Figure 2A:
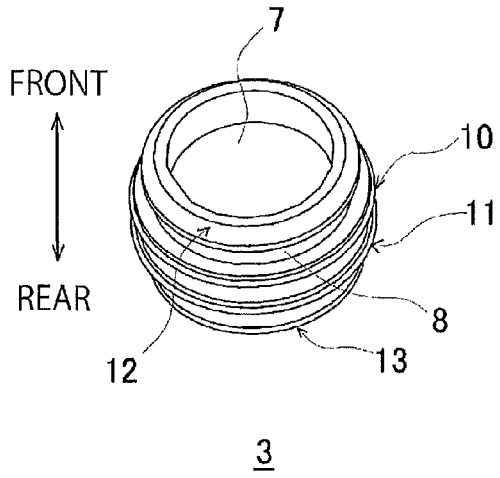
Figure 2B:
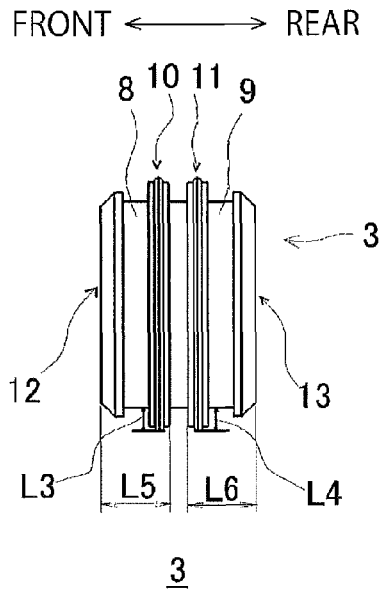
Figure 2C:
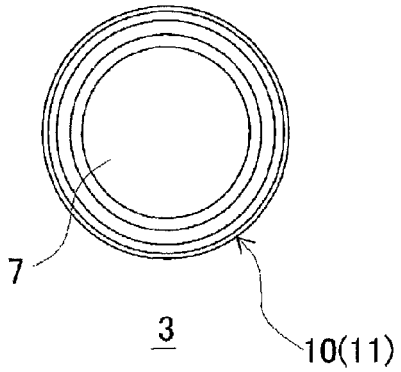
Figure 2D:
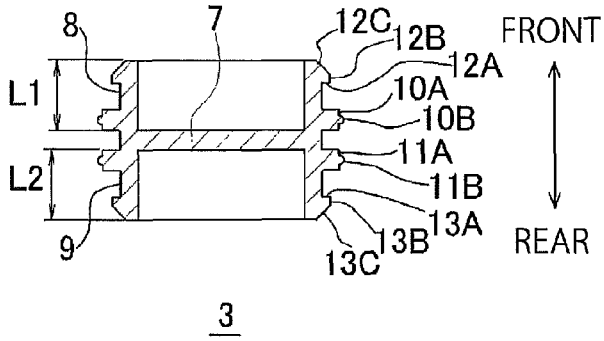

As shown in FIG. 2B, the projecting amount or length L3 of the first projecting portion 10 from the outer circumferential surface of the first cylindrical portion 8 is equal to the projecting amount or length L4 of the second projecting portion 11 from the outer circumferential surface of the second cylindrical portion 9.

As shown in FIG. 2B, the distance L5 between the front end of the first cylindrical portion 8 and the rear end of the first projecting portion 10 is equal to the distance L6 between the rear end of the second cylindrical portion 9 and the front end of the second projecting portion 11.

Because the cap 3 is formed as described above, the cap 3 can be inverted in the front-rear direction. That is, the cap 3 is reversible in the front-rear direction. Therefore, the cap 3 can be mounted on the filling port 6 in such an orientation that a front end of the cap 3 (that is, a tip end of the first cylindrical portion 8 where the third projecting portion 12 is provided) faces the front, or in such an orientation that a rear end of the cap 3 (that is, a tip end of the second cylindrical portion 9 where the fourth projecting portion 13 is provided) faces the front.

3. Mounting of Cap

Next will be described with reference to FIG. 3 how to mount the cap 3 on the container body 2.

The container body 2 includes a cylindrical partition surface 15 that partitions the filling port 6 from a remaining part of the container body 2. A projecting portion 16 is formed at a front end of the partition surface 15. The projecting portion 16 projects radially inwardly from the partition surface 15.

The projecting portion 16 includes an inclined surface 16A, an opposing surface 16B, a connection surface 16C, and an orthogonal surface 16D. The inclined surface 16A is gradually inclined radially inwardly toward the front. The opposing surface 16B is provided at a front end of the projecting portion 16 and extends straight in the radial direction. The opposing surface 16B faces either the first orthogonal surface 12A or second orthogonal surface 13A of the cap 3. The connection surface 16C connects the inclined surface 16A and the opposing surface 16B and extends straight in the front-rear direction. The inner diameter of the connection surface 16C is smaller than the maximum diameter of the third projecting portion 12 and the fourth projecting portion 13. Therefore, the third projecting portion 12 or the fourth projecting portion 13 is bent radially inwardly when the cap 3 is mounted on the container body 2. The orthogonal surface 16D is perpendicular to the partition surface 15, and is connected to a rear end of the inclined surface 16A.

Because the cap 3 is reversible in the front-rear direction as described above, the cap 3 may be mounted on the filling port 6 in such an orientation that the front end of the cap 3 faces the front, or in such an orientation that the rear end of the cap 3 faces the front. The following description is directed to the case where the cap 3 is mounted on the filling port 6 in such an orientation that the front end of the cap 3 faces the front.

Figure 3:
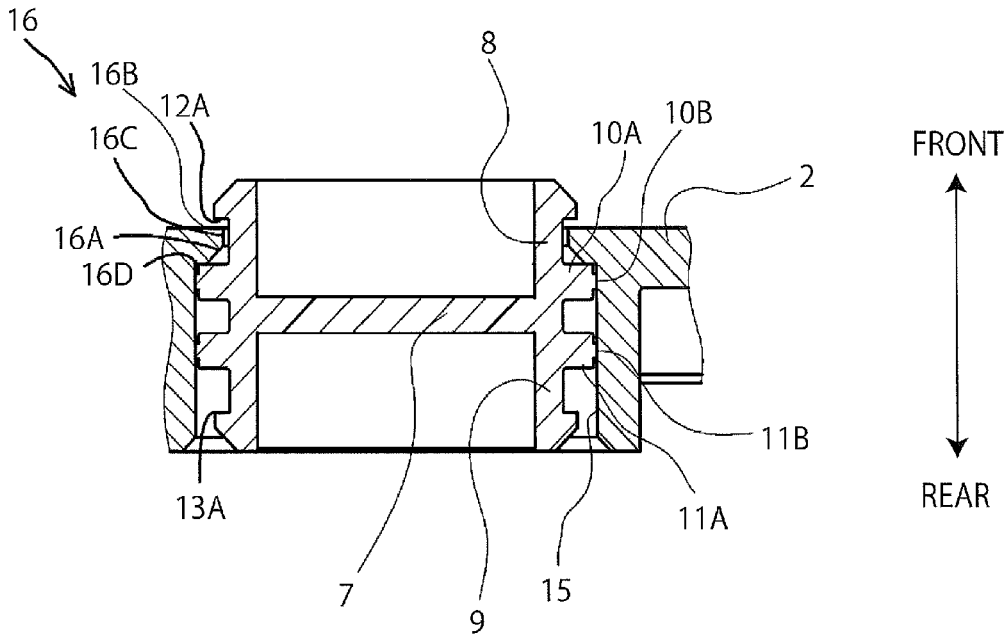
FIG. 3 is a cross-sectional view showing the cap mounted on a container body.

As shown in FIG. 3, when the cap 3 is mounted on the container body 2, the first contact portion 10B and the second contact portion 11B are in contact with the entire length of the partition surface 15 in the circumferential direction of the partition surface 15. However, the first projecting portion 10A or the second projecting portion 11A is not in contact with the partition surface 15. The front end of the first projecting portion 10A is in contact with the orthogonal surface 16D of the projecting portion 16. The first orthogonal surface 12A of the cap 3 faces the opposing surface 16B of the container body 2 in the front-rear direction. The rear end of the cap 3 is flush with the rear end of the partition surface 15.

4. Operation and Effect (1) As described above, the cap 3 includes the base 7, the first cylindrical portion 8, the second cylindrical portion 9, the first projecting portion 10, and the second projecting portion 11. The base 7 is in the shape of a circular plate. The first cylindrical portion 8 is in the shape of a cylinder extending from the periphery of the base 7 to the front side. The second cylindrical portion 9 is in the shape of a cylinder extending from the periphery of the base 7 to the rear side. The first projecting portion 10 projects radially outwardly from the outer circumferential surface of the first cylindrical portion 8 with the projecting amount L3. The first projecting portion 10 extends along the circumferential direction of the first cylindrical portion 8. The first projecting portion 10 extends over the entire circumferential length of the first cylindrical portion 8. The second projecting portion 11 projects radially outwardly from the outer circumferential surface of the second cylindrical portion 9 with the projecting amount L4. The projecting amount L4 is equal to the projecting amount L3. The second projecting portion 11 extends along the circumferential direction of the second cylindrical portion 9. The second projecting portion 11 extends over the entire circumferential length of the second cylindrical portion 9.

The cap 3 can be mounted on the container body 2 in such an orientation that the front end of the cap 3 faces the front, or in such an orientation that the rear end of the cap 3 faces the front. Therefore, compared with a cap that can be mounted only in one direction, the cap 3 can help save time and effort when being mounted.

(2) The front-rear length L1 of the first cylindrical portion is equal to the front-rear length L2 of the second cylindrical portion 9.

As a result, even when the cap 3 is mounted on the container body 2 in such an orientation that the front end thereof faces the front or in such an orientation that the rear end thereof faces the front, the base 7 remains at, the same position in the front-rear direction. Therefore, the cap 3 can help save time and effort when being mounted.

(3) The length L5 between the first projecting portion 10 and the front end of the first cylindrical portion 8 is equal to the length L6 between the second projecting portion 11 and the rear end of the second cylindrical portion 9.

As a result, even when the cap 3 is mounted on the container body 2 in such an orientation that the front end thereof faces the front or in such an orientation that the rear end thereof faces the front, the projecting portions 10 and 11 remain at the same positions in the front-rear direction. Therefore, the cap 3 can help save time and effort when being mounted.

(4) The developer container 1 includes the container body 2 and the cap 3. The filling port 6 is formed on the container body 2. Through the filling port 6, toner is filled in the container body 2. The cap 3 is mounted on the container body 2. The container body 2 includes the cylindrical partition surface 15 partitioning the filling port 6 from a remaining part of the container body 2, thereby defining the filling port 6.

The cap 3 includes: the base 7; the first cylindrical portion 8; the second cylindrical portion 9; the first projecting portion 10; and the second projecting portion 11. The base 7 is in the shape of a circular plate. The first cylindrical portion 8 is in the shape of a cylinder extending from the peripheral portion of the base 7 to the front side of the cap 3. The second cylindrical portion 9 is in the shape of a cylinder extending from the peripheral portion of the base 7 to the rear side. The first projecting portion 10 projects radially outwardly from the outer circumferential surface of the first cylindrical portion 8. The first projecting portion 10 extends along the circumferential direction of the first cylindrical portion 8. The first projecting portion 10 extends over the entire circumferential length of the first cylindrical portion 8. The first projecting portion 10 is in contact with the entire length of the partition surface 15 along the circumferential direction of the partition surface 15. The second projecting portion 11 projects radially outwardly from the outer circumferential surface of the second cylindrical portion 9. The second projecting portion 11 extends along the circumferential direction of the second cylindrical portion 9. The second projecting portion 11 extends over the entire circumferential length of the second cylindrical portion 9. The second projecting portion 11 is in contact with the entire length of the partition surface 15 along the circumferential direction of the partition surface 15.

Thus, the first projecting portion 10 and the second projecting portion 11 are in contact with the entire length of the partition surface 15 along the circumferential direction of the partition surface 15. Therefore, leakage of toner from the container body 2 can be prevented.

(5) The projecting portion 16 is formed at the front end of the partition surface 15 in the container body 2. The projecting portion 16 projects radially inwardly from the partition surface 15. The cap 3 includes the third projecting portion 12 and the fourth projecting portion 13. The third projecting portion 12 projects radially outwardly from the outer circumferential surface of the first cylindrical portion 8 at the front end of the first cylindrical portion 8. The fourth projecting portion 13 projects radially outwardly from the outer circumferential surface of the second cylindrical portion 9 at the rear end of the second cylindrical portion 9.

When the cap 3 is mounted on the container body 2 with the end of the cap 3 facing the front, the third projecting portion 12 is disposed at the front side of the projecting portion 16 in the front-rear direction, and faces the projecting portion 16 in the front-rear direction. As a result, as the cap 3 is moved to the rear side, the third projecting portion 12 comes in contact with the projecting portion 16, thereby preventing the cap 3 from being detached from the container body 2.

When the cap 3 is mounted on the container body 2 with the rear end of the cap 3 facing the front, the fourth projecting portion 13 is disposed at the front side of the projecting portion 16 in the front-rear direction, and faces the projecting portion 16 in the front-rear direction. As a result, as the cap 3 is moved to the rear side, the fourth projecting portion 13 comes in contact with the projecting portion 16, thereby preventing the cap 3 from being detached from the container body 2.

(6) The third projecting portion 12 extends along the circumferential direction of the first cylindrical portion 8. The third projecting portion 12 extends over the entire circumferential length of the first cylindrical portion 8. The fourth projecting portion 13 extends along the circumferential direction of the second cylindrical portion 9. The fourth projecting portion 13 extends over the entire circumferential length of the second cylindrical portion 9.

When the cap 3 is moved to the rear side, the third projecting portion 12 or fourth projecting portion 13 always comes in contact with the projecting portion 16, thereby preventing the cap 3 from being detached from the container body 2.

(7) The rear end of the cap 3 is flush with the rear end of the partition surface 15.

As a result, a seal that is used to cover the cap 3 from the rear side of the cap 3 can be easily attached onto the container body 2. Moreover, the seal attached on the container body 2 is unlikely to be peeled off.

Second Embodiment

Next will be described a cap 20 according to a second embodiment with reference to FIGS. 4A-4C. In the second embodiment, the cap 20 is mounted on the container body 2, thereby making up a developer container 1. Incidentally, the configuration of the cap 20 is the same as that of the cap 3 in the first embodiment except that reinforcing ribs 21 and 22 are formed on the cap 20. Therefore, details in the configuration of those parts other than the reinforcing ribs 21 and 22 will not be described.

Figure 4A:
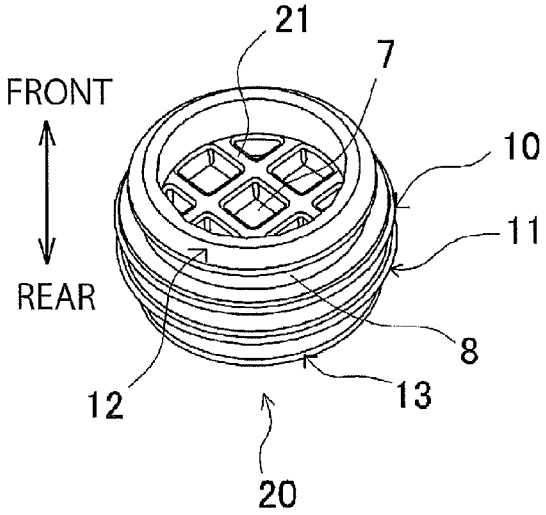
Figure 4B:
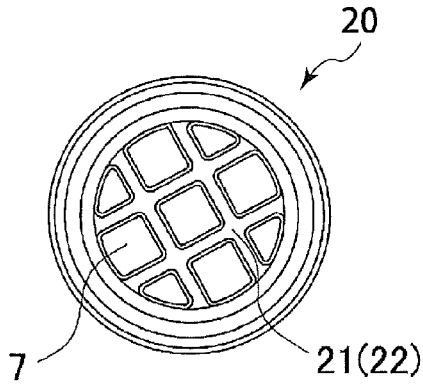
Figure 4C:
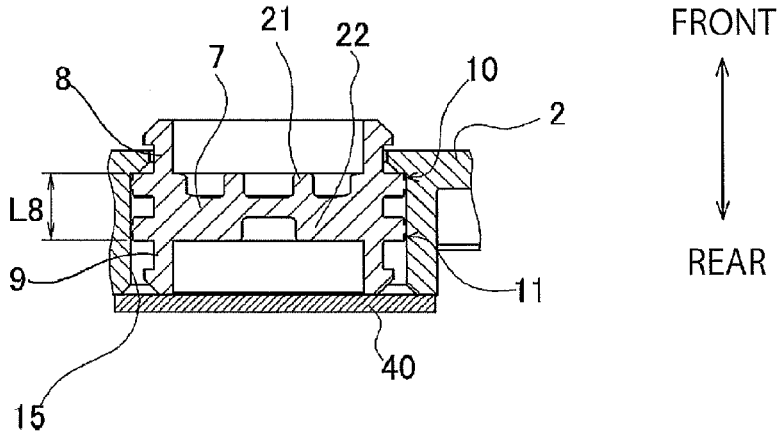

As shown in FIGS. 4A-4C, the cap 20 includes the first reinforcing ribs 21 and the second reinforcing ribs 22. The first reinforcing ribs 21 project from surface of the base 7 on which the first cylindrical portion 8 is provided. The second reinforcing ribs 22 project from a surface of the base 7 on which the second cylindrical portion 9 is provided.

As shown in FIG. 4B, the first reinforcing ribs 21 and the second reinforcing ribs 22 have a lattice-like structure when seen from the front-rear direction. As shown in FIG. 4C, the first reinforcing ribs 21 and the second reinforcing ribs 22 are disposed at asymmetrical positions in the front-rear direction. The distance L8 between the front end of the first projecting portion 10 and the rear end of the second projecting portion 11 is equal to the distance between the front end of the first reinforcing ribs 21 and the rear end of the second reinforcing ribs 22.

It is noted that parts of the cap 20 that are radially inward of the first cylindrical portion 8 and the second cylindrical portion 9 and that are in the same positions with the first projecting portion 10 and the second projecting portion 11 in the front-rear direction should have the greatest strength in the cap 20. According to the present embodiment, these parts of the cap 20 are reinforced by the first reinforcing ribs 21 and the second reinforcing ribs 22. Therefore, the cap 20 is unlikely to deform even when the first projecting portion 10 and the second projecting portion 11 come in contact with the partition surface 15 of the container body 2. Because the base 7 is reinforced by the reinforcing ribs 21 and 22, the strength of the cap 20 is increased.

As shown in FIG. 4C, a seal 40 is attached on the container body 2 so as to cover the rear side of the cap 20. Therefore, the rear side of the cap 20 is not exposed. A user is unlikely to touch the cap 20 accidentally.

Third Embodiment

A cap 30 according to a third embodiment will be described with reference to FIGS. 5A-5C. In the third embodiment, the cap 30 is mounted on the container body 2, thereby making up a developer container 1. Incidentally, the configuration of the cap 30 is the same as that of the cap 20 in the second embodiment except that the cap 30 has first and second cylindrical portions 31 and 32 in place of the first and second cylindrical portions 8 and 9 in the second embodiment. Details in the configuration of those parts other than the first and second cylindrical portions 31 and 32 will not be described.

Figure 5A:
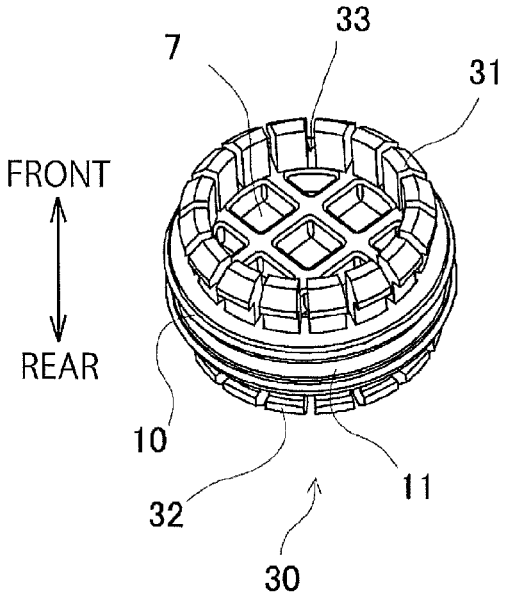
Figure 5B:
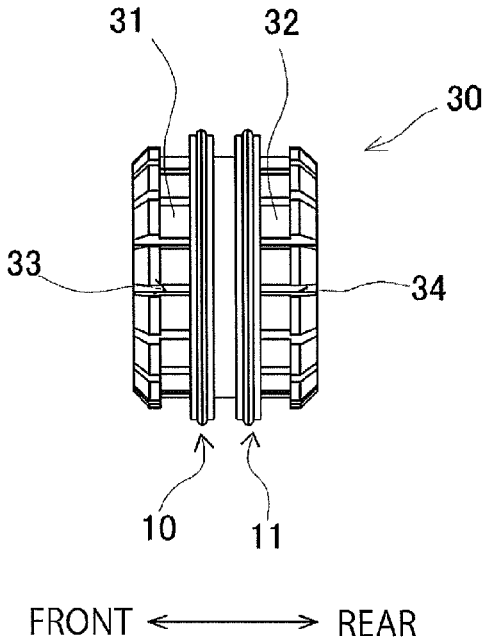
Figure 5C:
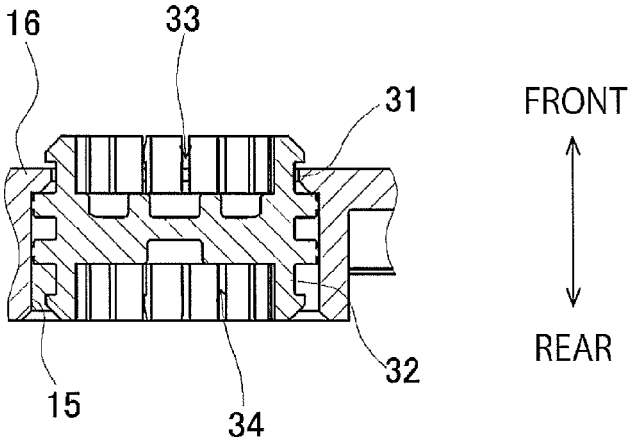

As shown in FIGS. 5A-5C, in the cap 30, the first cylindrical portion 31 is formed with a plurality of first notches 33, and the second cylindrical portion 32 is formed with a plurality of second notches 34. The first and second notches 33 and 34 extend in the front-rear direction.

As shown in FIG. 5B, the first notches 33 extend from the front end of the first cylindrical portion 31 to the front end of the first projecting portion 10. The first notches 33 are spaced at a regular or uniform interval along the circumference of the first cylindrical portion 31. The first notches 33 penetrate the first cylindrical portion 31 in the radial direction. The second notches 34 extend from the rear end of the second cylindrical portion 32 to the rear end of the second projecting portion 11. The second notches 34 are spaced at a regular or uniform interval along the circumference of the second cylindrical portion 32. The second notches 34 penetrate the second cylindrical portion 32 in the radial direction.

According to the above-described configuration, when the cap 30 is mounted on the container body 2, the first cylindrical portion 31 and the second cylindrical portion 32 can be easily bent radially inwardly, thereby making it easy for the cap 30 to be mounted on the container body 2. Moreover, it is possible to define the direction in which the first cylindrical portion 31 and the second cylindrical portion 32 are bent when the cap 30 is mounted on the container body 2.

Fourth Embodiment

Figure 6:
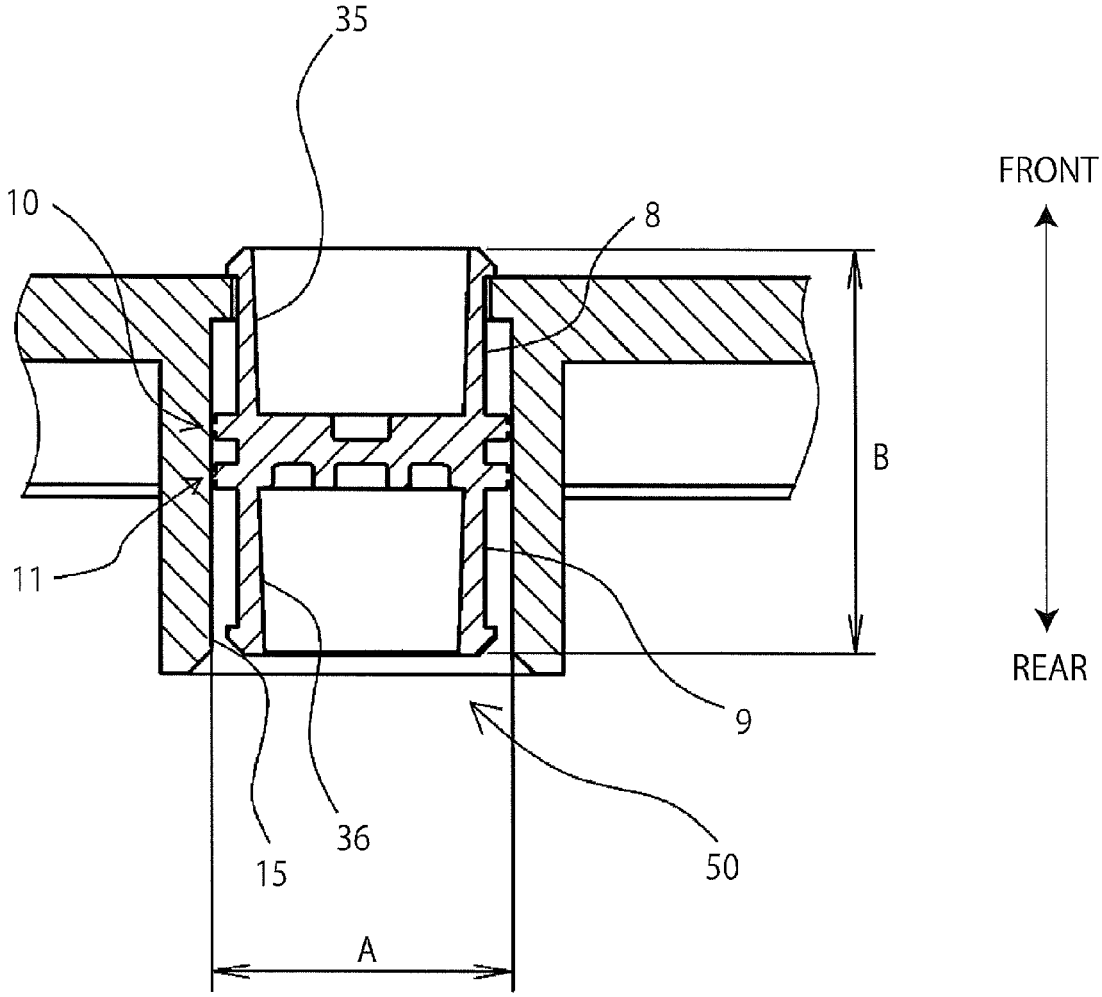
FIG. 6 is a diagram showing how a cap according to a fourth embodiment is mounted on the container body.

Next will be described a cap 50 according to a fourth embodiment with reference to FIG. 6. In the fourth embodiment, the cap 50 is mounted on the container body 2, thereby making up a developer container 1. The configuration of the cap 50 is the same as that of the cap 20 in the second embodiment except for the points described below:

As shown in FIG. 6, in the cap 50, a distance B between the front end of the first cylindrical portion 8 and the rear end of the second cylindrical portion 9 is larger than an outer diameter A of the first projecting portion 10 and second projecting portion 11. It is noted that the first projecting portion 10 and second projecting portion 11 project radially outwardly by the largest amounts in the cap 50. In other words, the diameter A is the maximum radial size of the cap 50. Therefore, even when the cap 50 is mounted onto a small-diameter filling port 6, the cap 50 remains on the filling port 6 in a stable manner because the front-rear size of the cap 50 is greater than the radial size of the cap 50.

An inner circumferential surface 35 of the first cylindrical portion 8 is gradually inclined radially outwardly toward the front. An inner circumferential surface 36 of the second cylindrical portion 9 is gradually inclined radially outwardly toward the front. The inclination degrees of the inner circumferential surfaces 35 and 36 are equal to inclination degrees of those surfaces that are formed in a metal model to define the inner circumferential surfaces 35 and 36 and from which the inner circumferential surfaces 35 and 36 are taken out. According to the above configuration, when the cap 50 is taken out of the metal mold after being molded by the metal mold, the cap 50 can be easily taken out.

The rear end of the cap 50 is positioned at a front side than the rear end of the partition surface 15 of the container body 2 in the front-rear direction. Therefore, the rear side of the cap 50 does not protrude out of the filling port 6. As a result, a user is unlikely to touch the cap 50 accidentally.

While the invention has been described in detail with reference to the embodiments thereof, it would be apparent to those skilled in the art that various changes and modifications may be made therein without departing from the spirit of the invention.

What is claimed is:

1. A cap for sealing a filling port formed in a developer container, the cap comprising:

a base in the shape of a circular plate;

a first cylindrical portion in the shape of a cylinder extending from a peripheral portion of the base in a first direction;

a second cylindrical portion in the shape of a cylinder extending from the peripheral portion of the base in a second direction that is opposite to the first direction;

a first projecting portion projecting radially outwardly from an outer circumferential surface of the first cylindrical portion with a predetermined projecting amount, the first projecting portion extending along a circumferential direction of the first cylindrical portion over an entire circumferential length of the first cylindrical portion; and a second projecting portion projecting radially outwardly from an outer circumferential surface of the second cylindrical portion with a projecting amount equal to the predetermined projecting amount of the first projecting portion, the second projecting portion extending along a circumferential direction of the second cylindrical portion over an entire circumferential length of the second cylindrical portion.

2. The cap according to claim 1, wherein the base is formed with a first reinforcing rib and a second reinforcing rib, the first reinforcing rib projecting from a surface of the base on which the first cylindrical portion is provided, and the second reinforcing rib projecting from a surface of the base on which the second cylindrical portion is provided, each of the first reinforcing rib and the second reinforcing rib being in a lattice-shape.

3. The cap according to claim 1, wherein a length of the first cylindrical portion in the first direction is equal to a length of the second cylindrical portion in the second direction.

4. The cap according to claim 1, wherein a distance between the first projecting portion and a downstream side end of the first cylindrical portion in the first direction is equal to a distance between the second projecting portion and a downstream side end of the second cylindrical portion in the second direction.

5. The cap according to claim 2, wherein a distance between a downstream side end of the first projecting portion in the first direction and a downstream side end of the second projecting portion in the second direction is equal to a distance between a downstream side end of the first reinforcing rib in the first direction and a downstream side end of the second reinforcing rib in the second direction.

6. The cap according to claim 1, wherein the first cylindrical portion is formed with a plurality of first notches, the first notches extending in the first direction, and the second cylindrical portion is formed with a plurality of second notches, the second notches extending in the second direction.

7. The cap according to claim 1, wherein a distance between a downstream side end of the first cylindrical portion in the first direction and a downstream side end of the second cylindrical portion in the second direction is larger than an outer diameter of the first projecting portion and the second projecting portion.

8. The cap according to claim 1, wherein the first cylindrical portion includes an inner circumferential surface that is gradually inclined radially outwardly toward a downstream side in the first direction, and the second cylindrical portion includes an inner circumferential surface that is gradually inclined radially inwardly toward a downstream side in the second direction.

9. A developer container comprising:

a container body formed with a filling port for filling developer; and a cap mounted on the container body, wherein the container body has a partition surface in the shape of a cylinder, the partition surface defining the filling port, and wherein the cap includes:

a base in the shape of a circular plate;

a first cylindrical portion in the shape of a cylinder extending from a peripheral portion of the base to a downstream side in a cap mounting direction, in which the cap is mounted;

a second cylindrical portion in the shape of a cylinder extending from the peripheral portion of the base to an upstream side in the cap mounting direction;

a first projecting portion projecting radially outwardly from an outer circumferential surface of the first cylindrical portion, the first projecting portion extending along a circumferential direction of the first cylindrical portion over an entire circumferential length of the first cylindrical portion, an entire length of the partition surface along a circumferential direction of the partition surface being in contact with the first projecting portion; and a second projecting portion projecting radially outwardly from an outer circumferential surface of the second cylindrical portion, the second projecting portion extending along a circumferential direction of the second cylindrical portion over an entire circumferential length of the second cylindrical portion, an entire length of the partition surface along the circumferential direction of the partition surface being in contact with the second projecting portion.

10. The developer container according to claim 9, wherein the base is formed with a first reinforcing rib and a second reinforcing rib, the first reinforcing rib projecting from a surface of the base on which the first cylindrical portion is provided, and the second reinforcing rib projecting from a surface of the base on which the second cylindrical portion is provided, each of the first reinforcing rib and the second reinforcing rib being in a lattice-shape.

11. The developer container according to claim 9, wherein a distance between the base and a downstream side end of the first cylindrical portion in the cap mounting direction is equal to a distance between the base and an upstream side end of the second cylindrical portion in the cap mounting direction.

12. The developer container according to claim 9, wherein a distance between the first projecting portion and a downstream side end of the first cylindrical portion in the cap mounting direction is equal to a distance between the second projecting portion and an upstream side end of the second cylindrical portion in the cap mounting direction.

13. The developer container according to claim 10, wherein a distance between a downstream side end of the first projecting portion in the cap mounting direction and an upstream side end of the second projecting portion in the cap mounting direction is equal to a distance between a downstream side end of the first reinforcing rib in the cap mounting direction and an upstream side end of the second reinforcing rib in the cap mounting direction.

14. The developer container according to claim 9, wherein the partition surface of the container body is formed with a projection, the projection projects radially inwardly from a downstream side end of the partition surface in the cap mounting direction, the cap includes:

a third projecting portion formed on a downstream side end of the first cylindrical portion in the cap mounting direction and projecting radially outwardly from an outer circumferential surface of the first cylindrical portion; and a fourth projecting portion formed on an upstream side end of the second cylindrical portion in the cap mounting direction and projecting radially outwardly from an outer circumferential surface of the second cylindrical portion, and the third projecting portion is disposed at a downstream side of the projection in the cap mounting direction, and faces the projection in the cap mounting direction.

15. The developer container according to claim 14, wherein the third projecting portion extends along the circumferential direction of the first cylindrical portion over the entire circumferential length of the first cylindrical portion, and the fourth projecting portion extends along the circumferential direction of the second cylindrical portion over the entire circumferential length of the second cylindrical portion.

16. The developer container according to claim 9, wherein the first cylindrical portion is formed with a plurality of first notches, the first notches extending in the cap mounting direction, and the second cylindrical portion is formed with a plurality of second notches, the second notches extending in the cap mounting direction.

17. The developer container according to claim 9, wherein a distance between a downstream side end of the first cylindrical portion in the cap mounting direction and an upstream side end of the second cylindrical portion in the cap mounting direction is larger than an outer diameter of the first projecting portion and the second projecting portion.

18. The developer container according to claim 9, wherein the first cylindrical portion includes an inner circumferential surface that is gradually inclined radially outwardly toward a downstream side in the cap mounting direction, and the second cylindrical portion includes an inner circumferential surface that is gradually inclined radially outwardly toward a downstream side in the cap mounting direction.

19. The developer container according to claim 9, wherein an upstream side end of the cap in the cap mounting direction is flush with an upstream side end of the partition surface in the cap mounting direction.

20. The developer container according to claim 9, wherein an upstream side end of the cap in the cap mounting direction is positioned at a downstream side in the cap mounting direction from an upstream side end of the partition surface in the cap mounting direction.

21. The developer container according to claim 9, further comprising a covering member covering an upstream side in the cap mounting direction of the cap.

* * * * *